US005550014A

United States Patent [19]

Maruyama et al.

[11] Patent Number: 5,550,014

[45] **Date of Patent: *Aug. 27, 1996**

[54] SILVER HALIDE PHOTOGRAPHIC EMULSION, METHOD OF MANUFACTURING THE SAME, AND PHOTOGRAPHIC LIGHT SENSITIVE MATERIAL

[75] Inventors: Yoichi Maruyama; Mikio Ihama, both of Minami-Ashigara, Japan

[73] Assignee: Fuji Photo Film Co., Ltd., Kanagawa, Japan

[ * ] Notice: The term of this patent shall not extend beyond the expiration date of Pat. No. 5,096.806.

[21] Appl. No.: 407,056

[22] Filed: Mar. 17, 1995

Related U.S. Application Data

[63] Continuation of Ser. No. 200,298, Feb. 23, 1994, abandoned, which is a continuation of Ser. No. 621,871, Dec. 4, 1990, abandoned.

[30] Foreign Application Priority Data

Dec. 5, 1989 [JP] Japan ..... 1-314201

[51] Int. Cl.[6] ..... G03C 1/005

[52] U.S. Cl. ..... 430/567; 430/505; 430/509

[58] Field of Search ..... 430/567, 569, 430/505

[56] References Cited

U.S. PATENT DOCUMENTS

| | | | |
|---|---|---|---|
| 4,735,894 | 4/1988 | Ogawa . | |
| 4,806,461 | 2/1989 | Ikeda et al. | 430/567 |
| 4,865,962 | 9/1989 | Hasebe et al. | 430/567 |
| 5,011,767 | 4/1991 | Yamashita et al. | 430/567 |
| 5,061,614 | 10/1991 | Takada et al. . | |
| 5,079,138 | 1/1992 | Takada . | |
| 5,096,806 | 3/1992 | Nakamura et al. | 430/569 |

FOREIGN PATENT DOCUMENTS 0282896 9/1988 European Pat. Off. .

OTHER PUBLICATIONS

Journal of Imaging Science, vol. 32, No. 4, Jul. 1988, pp. 160–177; J. E. Maskasky: "Epitaxial Selective Site Sensitization of Tabular Grain Emulsions".

Journal of Imaging Science, vol. 33, No. 3, May 1989, pp. 87–91; Gao et al., "A New and Convenient Method for the Analysis of the Silver Halide Distribution in Tabular Photographic Silver Halide Microcrystals".

Imaging Abstracts, No. 6, Nov. 1988, p. 312, S. Zhan et al.: "Study of the Preparation, Structure and Properties of Tabular Silver Halide Crystals; Part III. Influence of the Iodine Distribution".

*Primary Examiner*—Thorl Chea

*Attorney, Agent, or Firm*—Birch, Stewart, Kolasch & Birch, LLP

[57] ABSTRACT

A silver halide photographic emulsion contains tabular silver halide grains which have an aspect ratio of 2 or more and in which dislocations are concentrated about the corner of the grain.

25 Claims, 2 Drawing Sheets

SILVER HALIDE PHOTOGRAPHIC EMULSION, METHOD OF MANUFACTURING THE SAME, AND PHOTOGRAPHIC LIGHT SENSITIVE MATERIAL

This application is a continuation, of application Ser. No. 08/200,298 filed on Feb. 23, 1994, now abandoned, which is a continuation, of application Ser. No. 07/621,871 filed on Dec. 4, 1990, now abandoned.

BACKGROUND OF THE INVENTION

1. Field of the Invention

The present invention relates to a silver halide emulsion and a photographic light-sensitive material using the same and, more particularly, to a tabular silver halide photographic emulsion having high photographic sensitivity and a photographic light-sensitive material using the same.

2. Description of the Related Art

Methods of manufacturing and using tabular silver halide grains (to be also referred to as simply "tabular grains" hereinafter) are disclosed in, e.g., U.S. Pat. Nos. 4,434,226, 4,439,520, 4,414,310, 4,433,048, 4,414,306, and 4,459,353. The tabular grain is known for its various advantages such as high sensitivity including improvement in color sensitizing efficiency obtained by a sensitizing dye, improvement in a sensitivity/graininess relationship, improvement in sharpness obtained by unique optical properties of the tabular grain, and improvement in covering power.

In recent years, however, as the sensitivity of a silver halide color light-sensitive material has been increased and its small formatting has progressed, a strong demand has arisen for a color photographic light-sensitive material having high sensitivity and high image quality.

For this reason, although a silver halide emulsion having higher sensitivity and better graininess is required, no conventional tabular silver halide emulsion can satisfy the above requirements, and a demand has arisen for an emulsion having higher performance.

Observation of dislocations in silver halide grains are described in, e.g.:

1. C. R. Berry, J. Appl. Phys., 27, 636 (1956)
2. C. R. Berry, D. C. Skilman, J. Appl. Phys., 35, 2165 (1964)
3. J. F. Hamilton, Phot. Sci. Eng., 11, 57 (1967)
4. T. Shiozawa, J. Soc. Phot. Sci. Jap. 34, (1971)
5. T. Shiozawa, J. Soc. Phot. Sci. Jap., 35, 213 (1972)

These references describe that dislocations in crystals can be observed by an X-ray diffraction method or a cryro-transmission electron microscopic method and various dislocations can be formed in crystals by giving distortion to the crystals.

In these references, dislocations are not formed in silver halide grains during formation of a photographic emulsion on purpose. JP-A-63-220238 ("JP-A" means unexamined published Japanese patent application) and JP-A-1-201649, however, describe silver halide grains in which dislocations are formed on purpose. According to these patent specifications, tabular grains having dislocation lines to some extent are superior to tabular grains having no dislocation lines in photographic properties such as sensitivity and reciprocity. In addition, good sharpness and graininess can be imparted to a light-sensitive material by using these tabular grains. However, these tabular grains are still unsatisfactory.

SUMMARY OF THE INVENTION

The present invention has been made in consideration of the above situation, and has as its first object to provide a silver halide emulsion having high sensitivity.

It is a second object of the present invention to provide a silver halide emulsion having good reciprocity characteristics.

The above objects of the present invention can be achieved by the following means.

(1) A silver halide photographic emulsion containing tabular silver halide grains which have an aspect ratio of 2 or more and in which dislocations are concentrated about the corners of the grain.

(2) A silver halide photographic emulsion described in item (1), wherein tabular silver halide grains having a grain thickness of less than 0.5 μm, a grain size of 0.3 μm or more, and an aspect ratio of 2 or more account for at least 50% of a total projected area of all silver halide grains in the emulsion.

(3) A method of manufacturing a silver halide photographic emulsion described in item (2), comprising the steps of junctioning silver iodide or a silver halide having a high silver iodide content to the corners of tabular silver halide grain directly or via halide conversion using iodide ions, thereby forming junctioned silver halide grains, and subsequently growing the junctioned tabular grains.

(4) A photographic light-sensitive material having at least two light-sensitive silver halide emulsion layers having different color sensitivities on a support, wherein at least one of the emulsion layers contains a silver halide photographic emulsion described in item (2) and at least one coupler which couples with the oxidized form of a color developing agent to form a dye.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Figure 1:
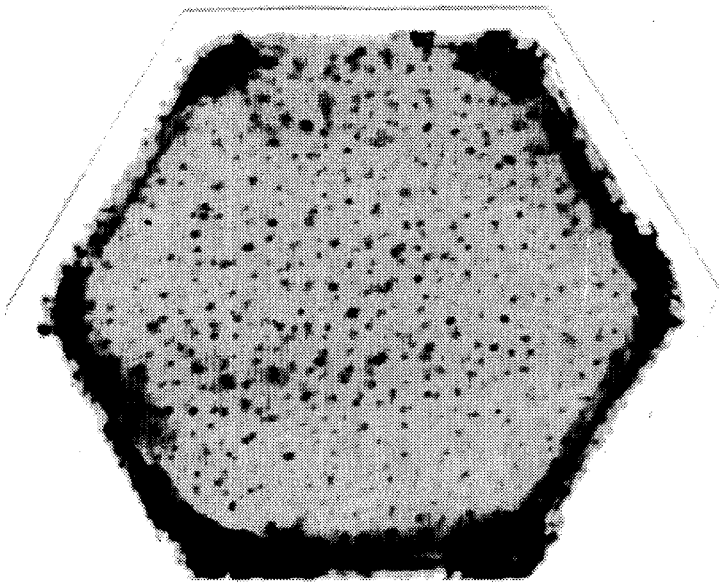
FIG. 1 is an electron micrograph (magnification=85,000) showing a crystal structure of a silver halide grain of an emulsion B-1 according to Example 1 of the present invention, in which dislocations are concentrated about the corners of the grain.

The present invention will be described in detail below.

An emulsion of the present invention contains one or more tabular silver halide grains having an aspect ratio of 2 or more, and preferably, 3 or more and less than 8. In this case, a "tabular silver halide grain" is a general term of silver halide grains having one twin plane or two or more parallel twinned faces. When all ions at lattice points on two sides of a (111) face have a mirror image relationship, this (111) face is a twin plane. When this tabular grain is viewed from above, its shape is a triangle, a hexagon, or a circular triangle or hexagon. The triangular, hexagonal, and circular grains have parallel triangular, hexagonal, and circular outer surfaces, respectively.

In the present invention, an average aspect ratio of tabular grains is an average value of values (aspect ratios) obtained by dividing grain sizes of tabular grains having grain diameter of 0.3 μm or more by their thicknesses. Measurement of the grain thickness can be easily performed as follows. That is, a metal is obliquely deposited on a grain together with a latex as a reference, the length of its shadow is measured on an electron micrograph, and the grain thickness is calculated with reference to the length of the shadow of the latex.

In the present invention, the grain diameter is a diameter of a circle having an area equal to a projected area of parallel outer surfaces of a grain.

The projected area of a grain can be obtained by measuring an area on an electron micrograph and correcting a photographing magnification.

The diameter of a tabular grain is preferably 0.3 to 5.0 μm. The thickness of a tabular grain is preferably 0.05 to 0.5 μm.

In the present invention, a ratio of tabular grains in an emulsion is 50%, and most preferably, 80% or more of a total projected area of all silver halide grains in the emulsion. More preferably, an average aspect ratio of the tabular grains occupying this predetermined area is 3 to less than 8. In addition, more preferable effects may be obtained by using monodispersed tabular grains. Although a structure of the monodispersed tabular grains and a method of manufacturing the same are described in, e.g., JP-A-63-151618, the shape of the grains will be briefly described below. That is, 70% or more of a total projected area of silver halide grains are occupied by tabular silver halide grains which are hexagonal grains in which a ratio of an edge having a maximum length to an edge having a minimum length is 2 or less and which have two parallel faces as outer surfaces, and a variation coefficient (a value obtained by dividing a variation (standard deviation) in grain sizes represented by a circle-equivalent diameter of a projected surface area) in grain size distribution of the hexagonal tabular silver halide grains is 20% or less, i.e., the grains have monodispersibility.

The tabular emulsion of the present invention have dislocations.

Dislocations in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, a silver halide grain is extracted from an emulsion so as not to apply a pressure capable of forming dislocations in the grain and placed on a mesh for electron microscopic observation, and observation is performed by cooling a sample so as to prevent damage (e.g., print out) caused by electron rays. In this case, as the thickness of a grain is increased, it becomes difficult to transmit electron rays. Therefore, a grain can be observed more clearly by using an electron microscope of high voltage type (200 kV or more with respect to a grain having a thickness of 0.25 μm). By using a photograph of a grain obtained by the above method, positions of dislocations can be obtained for each grain when the grain is viewed in a direction perpendicular to the major face.

Dislocations of the silver halide grain of the present invention are substantially concentrated about the corners of the tabular grain, or substantially concentrated in the neighborhood of the corners of the tabular grain. When the tabular grain has a triangular or hexagonal outer surface, "about the corners of the tabular grain" means a portion surrounded by perpendiculars, drawn from a point at an x % position from the center of a straight line connecting the center of a tabular grain and a corner to two edges defining the corner, and the edges, and a three-dimensional region throughout the entire thickness of the grain. The value of x is preferably 50 to less than 100, and more preferably, 75 to less than 100.

When the tabular grain has round corners, each corner is not clear. In this case, six tangents are obtained for the outer circumference of the grain, and a corner is obtained as a point at which a straight line connecting an intersection of the tangents and the center of the tabular grain crosses the outer circumference of the grain.

"Dislocations are substantially concentrated about the corners of a grain", means that a concentration of dislocation about the corners of the grain is higher than that in a portion of the grain except for a portion about the corners. The concentration of dislocation is defined by the number of dislocation lines included in a certain projected area. The dislocation concentration about the corner of a grain is preferably twice, and more preferably, 10 times that in a portion of the grain except for a portion about the corners.

When a grain has a hexagonal outer surface, six corners are present, and dislocations are concentrated about each corner. When dislocations are concentrated about at least one of the six corners, the effect of the present invention can be obtained.

A method of preparing tabular grains of the present invention will be described below.

The tubular grains of the present invention can be prepared by improving methods described in, e.g., Cleve, Photography Theory and Practice (1930), page 131; Gutoff, Photographic Science and Engineering, Vol. 14, pp. 248 to 257 (1970); and U.S. Pat. Nos. 4,434,226, 4,414,310, 4,433,048, and 4,439,520 and British Patent 2,112,157.

Any of silver bromide, silver iodobromide, silver iodochlorobromide, and silver chlorobromide can be used in the silver halide emulsion for use in the present invention. A preferable silver halide is silver iodobromide or silver chloroiodobromide containing 30 mol % or less of silver iodide.

The silver halide emulsion of the present invention may have a structure with respect to a halogen composition in the grain.

In order to form dislocations about the corner, silver iodide or a silver halide having a high silver iodide content is junctioned to the corners of a tabular grain to form a junctioned silver halide grain, and the tabular grain is grown again.

Silver iodide or a silver halide having a high silver iodide content, i.e., containing silver iodide at a content higher than at least that of a host grain, and preferably, 90 mol % or more and silver bromide or/and silver chloride as the balance can be junctioned to the corners of a tabular grain by either a direct method or an indirect method performed via halide conversion.

A method of junctioning a guest as silver iodide to a host grain as a face-centered cubic rock salt crystal structure by epitaxial growth is disclosed in a broad sense in JP-A-59-162540 (U.S. Pat. No. (4,463,087). According to this method, connecting by epitaxial growth can be performed by selecting silver salt which is non-isomorphorous with respect to the host grain crystal structure. In the embodiment of the above patent specification, however, only a large number of edge selective growth examples such as edge selective local epitaxial growth of silver thiocyanate on an octahedral silver bromide grain are disclosed. As for a tabular grain consisting of silver iodobromide (AgI=6 mol %), only an example in which silver thiocyanate is selectively epitaxially grown on the edge is disclosed, and no example of growing silver iodobromide at the corner of a tabular grain is disclosed in detail.

The present inventors have made extensive studies and found that silver iodide or a silver halide having a high silver iodide content can be directly junctioned by epitaxial growth to the corners of a tabular grain by using a tabular grain consisting of silver iodobromide as a host and adding aqueous solutions of potassium iodide and silver nitrate, in an amount of 0.5 to 10 and preferably 1 to 6 mol % of the silver of the host, at a high speed by a double jet method without using any site director. A preferable addition time is 5 to 0.2 minutes, and more preferably, 0.5 to 2 minutes.

Silver iodide or a silver halide having a high silver iodide content may be grown at the corners of a tubular grain by the following method. That is, a silver halide solvent is added to a solution containing host grains, and then aqueous solutions of potassium iodide and silver nitrate are added. In this case, the two aqueous solutions need not be added at high addition rates. The two aqueous solutions are added in an amount of 0.5 to 10 mol %, and preferably, 2 to 6 mol % with respect to the host grains.

Examples of the silver halide solvent are thiocyanate, ammonia, thioether, and thioureas.

More specifically, examples of the silver halide solvent are thiocyanate (e.g., U.S. Pat. Nos. 2,222,264, 2,448,534, and 3,320,069), ammonia, a thioether compound (e.g., U.S. Pat. Nos. 3,271,157, 3,574,628, 3,704,130, 4,297,439, and 4,276,347), a thione compound (e.g., JP-A-53-144319, JP-A-53-82408, and JP-A-55-77737), an amine compound (e.g., JP-A-54-100717), a thiourea derivative (e.g., JP-A-55-2982), imidazoles (e.g., JP-A-54-100717), and substituted mercaptotetrazole (e.g., JP-A-57-202531).

An indirect method of epitaxially junctioning silver iodide or a silver halide having a high silver iodide content to the corners of a tabular grain via halide conversion will be described below.

A method of epitaxially growing silver chloride at the corners of a tabular grain is described in JP-A-58-108526 (U.S. Pat. No. 4,435,501). This patent specification describes that the surface of a tabular grain as a host consists of essentially of at least 8 mol % of an iodide, epitaxial growth of silver chloride is performed adjacent to the corners without using a site director, and that a water-soluble iodide or an adsorptive site director is used in order to more limit the region of epitaxial growth at the corner or edge.

The present inventors have found that the objects of the present invention cannot be achieved by the method of allowing a tabular grain to adsorb a cyanine dye to epitaxially grow silver chloride at the corners as described in Example 4 of JP-A-58-108526. That is, when epitaxial grains prepared by this method are subjected to halide-conversion by an iodide to grow tabular grains, dislocations are formed not only about the corners but also on the edge or major surface. This reason is assumed that the sensitizing dye itself has a function of forming dislocations.

The present inventors have found that a water-soluble iodide is preferably used as a site director in order to epitaxially grow silver chloride. That is, potassium iodide is typically used. 0.03 to 3 mol %, and preferably, 0.5 to 1.5 mol % of potassium iodide is used with respect to the silver of a host tabular grain. This amount preferably corresponds to about 50% to 200% of a surface monoatomic covering amount of the tabular grain. Subsequently, silver nitrate and potassium chloride and the like are added by a double jet method, whereby silver chloride according to the objects of the present invention can be grown at the corners of a tabular grain. An addition amount of silver nitrate is preferably 0.1 to 10 mol % with respect to the silver of a host tabular grain.

Halide conversion of silver chloride performed by using potassium iodide will be described below. A silver halide having high solubility is converted into a silver halide having a lower solubility by adding halide ions capable of forming a silver halide having a lower solubility. This process is called halide conversion and described in U.S. Pat. No. 4,142,900. In the present invention, epitaxially grown silver chloride is selectively halide-converted by using potassium iodide to form a β-AgI region at the corners of a tabular grain. If an amount of potassium for halide conversion is too large, dislocations are dispersed. If the amount is too small, desired dislocations disappear upon recrystallization occurring in a subsequent grain growth step. If a proper amount of a silver chloride region is not present in this step, since potassium iodide causes halide conversion with silver bromide, dislocations are not concentrated in the subsequent grain growth step. A preferable amount of potassium iodide for halide conversion is 0.1 to 10 mol % with respect to the silver of a host tabular grain.

Growth of dislocations will be described below.

In the step of directly junctioning silver iodide by the direct method and the halide conversion step, a β-AgI region or a silver halide region having a high silver iodide content, which has a different crystal shape from that of a substrate silver bromide, silver iodobromide, silver chlorobromide, or silver chloroiodobromide (host tabular grain), is formed at the corners of the tabular grain. Subsequently, when a silver nitrate solution and potassium bromide solution, or a silver nitrate solution and solution mixture of potassium bromide and potassium iodide, is simultaneously added, grains are further grown, and at the same time dislocations are formed from the β-AgI region as a start point. Since the β-AgI region is localized about the corners, dislocations are concentrated about the corners. An addition amount of silver nitrate is an arbitrary value of 5 mol % or more with respect to the silver of the substrate. When a solution mixture of potassium bromide and potassium iodide is to be added, a ratio of mixing is preferably 0 to 0.4 of potassium iodide with respect to 1 of potassium bromide.

A photographic light-sensitive material of the present invention has at least two light-sensitive silver halide emulsion layers having different color sensitivities on a support, and at least one of the emulsion layers contain at least one coupler which couples with the oxidized form of a color developing agent to form a dye. The photographic light-sensitive material of the present invention can be applied to a multilayered silver halide color photographic light-sensitive material subjected to color development process, e.g., color paper, color reversal paper, a color positive film, a color negative film, a color reversal film, and a color direct positive light-sensitive material. In particular, the present invention can be preferably applied to color paper and color reversal paper.

In a multilayered silver halide color photographic light-sensitive material, light-sensitive layers are generally formed such that red-, green-, and blue-sensitive layers are arranged from a support in the order named or a reverse order. In accordance with an application, however, another light-sensitive layer such as an infrared-sensitive layer may be used, or light-sensitive layers having the same color sensitivity may sandwich a light-sensitive layer having different color sensitivity.

Non-light-sensitive layers such as various interlayers may be formed between the silver halide light-sensitive layers and as an uppermost layer or a lowermost layer.

As the non-light-sensitive layer, a protective layer, an interlayer, a filter layer, and an anti-halation layer can be used in accordance with an application. These layers may contain a non-light-sensitive emulsion, e.g., a fine grain emulsion.

A so-called back layer may be formed at a side of a support opposite to emulsion layers in order to adjust curling or prevent charging or adhesion. A back layer may be either a single layer or a plurality of layers.

Practical layer arrangements are, e.g., red-sensitive layer (R)/green-sensitive layer (G)/blue-sensitive layer (B)/support and B/G/R/support. A layer arrangement in which a plurality of layers having the same color sensitivity but different sensitivities are arranged is also effective. More specifically, an order of high-sensitivity blue-sensitive layer (BH)/low-sensitivity blue-sensitive layer (BL)/high-sensitivity green-sensitive layer (GH)/low-sensitivity green-sensitive layer (GL)/high-sensitivity red-sensitive layer (RH)/low-sensitivity red-sensitive layer (RL)/support or an arrangement in which high- and low-sensitivity layers of an arbitrarily color-sensitive layer are switched in this order.

As described in JP-B-55-34932 ("JP-B" means examined Japanese patent application), layers may be arranged in an order of blue-sensitive layer/GH/RH/GL/RL from the furthest side from a support. In addition, as described in JP-A-56-25738 and JP-A-62-63936, layers may be arranged in an order of blue-sensitive layer/GL/RL/GH/RH from the furthest side from a support.

Furthermore, layers may be arranged in an order of high-sensitivity emulsion layer/low-sensitivity emulsion layer/medium sensitivity emulsion layer or low-sensitivity emulsion layer/medium-sensitivity emulsion layer/high-sensitivity emulsion layer.

In order to improve color reproducibility, a donor layer (CL) with an donor effect having a different spectral sensitivity distribution from those of main light-sensitive layers such as BL, GL, and RL are preferably arranged adjacent to or close to the main light-sensitive layers.

As described above, various layer arrangements and orders can be selected in accordance with the application of a light-sensitive material.

A silver halide emulsion to be used together with the emulsion of the present invention may have any halogen composition such as silver iodobromide, silver bromide, silver chlorobromide, and silver chloride.

Although a halogen composition of an emulsion may be different between grains, uniform properties can be easily obtained between grains when an emulsion having an equal halogen composition between grains is used. As a halogen composition distribution inside a silver halide emulsion grain, a grain having a so-called uniform structure in which a composition is equal in any portion of a silver halide grain, a grain having a so-called layered structure having different halogen compositions in a core of a silver halide grain and a shell (one or a plurality layers) surrounding the core, or a grain having a structure in which a non-layer portion having a different halogen composition is formed inside or the surface of the grain (if the portion is formed on the grain surface, the portion having a different composition is junctioned to the edge, the corner, or the face of the grain) may be arbitrarily selected. In order to obtain high sensitivity, the latter two types of grains can be used more advantageously than the grain having the uniform structure. These two types are preferable in terms of a pressure resistance. When the silver halide grain has the above structure, a boundary portion between portions having different halogen compositions may be a clear boundary or a unclear boundary in which a mixed crystal is formed due to a composition difference. In addition, the structure may be continuously changed on purpose.

A halogen composition varies in accordance with the type of light-sensitive material. For example, a silver chlorobromide emulsion is mainly used in a printing material such as color paper, and a silver iodobromide emulsion is mainly used in a photographic material such as a color negative film.

A so-called high silver chloride emulsion having a high silver chloride content is preferably used in a light-sensitive material suitable for a rapid treatment. The silver chloride content of the high silver chloride emulsion is preferably 90 mol % or more, and more preferably, 95 mol % or more.

Such a high silver chloride emulsion preferably has a structure in which a silver bromide localized region is formed in the form of layer or non-layer inside the silver halide grain and/or the surface thereof. A halogen composition at the localized region preferably has a silver bromide content of at least 10 mol %, and more preferably, 20 mol % or more. The localized regions can be formed inside a grain or on the edge, the corner, and the face of the grain surface. For example, the localized region is preferably epitaxially grown at the corner portion of a grain.

An average grain size of silver halide grains which can be used in the light-sensitive material of the present invention (the average grain size is a grain diameter if grains are spherical or almost spherical, and length of edge if grains are cubic, each based on a projected area and the average grain size is represented by a sphere-equivalent diameter also if grains are tabular grains) is preferably 0.1 to 2 μm, and most preferably, 0.15 to 1.5 μm. Although a grain size distribution may be narrow or wide, a so-called monodisperse silver halide emulsion in which a value (variation coefficient) obtained by dividing a standard deviation of a grain size distribution curve of a silver halide emulsion by an average grain size is 20% or less, and most preferably, 15% or less can be coused in the light-sensitive material of the present invention. In order to satisfy gradation as an object of the present invention, in an emulsion layer having essentially the same color sensitivity, two or more types of monodisperse silver halide emulsions (preferably having the above variation coefficient as monodispersibility) having different grain sizes can be mixed in the same layer or coated on different layers. In addition, two or more types of polydisperse silver halide emulsions or a combination of monodisperse and polydisperse emulsions can be mixed or layered in different layers.

The silver halide grains for use in the light-sensitive material of the present invention may have regular crystals such as cubic, octahedral, dodecahedral, and tetradecahedral crystals, a mixture thereof, irregular crystals such as a spherical crystal, or a composite form of these crystals. Also, tabular grains may be used.

The silver halide emulsion which can be used in the present invention can be prepared by methods described in, e.g., Research Disclosure (RD) No. 17643 (December, 1978), PP. 22 and 23, "I. Emulsion preparation and types"; RD No. 18716 (November, 1979), page 648; P. Glafkides, "Chemie et Phisique Photograph-iquie", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in U.S. Pat. Nos. 3,574,628 and 3,655,394 and British Patent 1,413,748 can be preferably used.

Tabular grains having an aspect ratio of about 5 or more can be used in the present invention. The tabular grains can be easily prepared by methods described in, e.g., Gutoff, "Photographic Science and Engineering", Vol. 14, PP. 248 to 257, (1970); U.S. Pat. Nos. 4,434,226, 4,414,310, 4,433,048, and 4,439,520; and British Patent 2,112,157.

The crystal structure may be uniform, may consist of different halogen compositions in inner and outer portions, or may be a layered structure. In addition, a silver halide having a different composition may be bonded by an epitaxial junction, or a compound other than a silver halide such as silver rhodanate or zinc oxide may be bonded.

Also, a mixture of grains having various crystal shapes can be used.

The photographic emulsion of the present invention and the silver halide emulsion to be used together with the emulsion of the present invention are normally subjected to physical ripening, chemical ripening, and spectral sensitization. Additives used in these processes are described in Research Disclosure Nos. 17643 and 18716, and they are summarized in the following table.

Known photographic additives which can be used together with the photographic emulsion of the present invention are also described in the above two Research Disclosures, and they are summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25<br>pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

In order to prevent degradation in photographic properties caused by formaldehyde gas, a compound which can react with and fix formaldehyde described in U.S. Pat. Nos. 4,411,987 or 4,435,503 is preferably added to the light-sensitive material.

Various color couplers can be used in the light-sensitive material of the present invention. Specific examples of these couplers are described in above-described Research Disclosure (RD), No. 17643, VII-C to VII-G as patent references.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,565,630, and WO No. 04795/88.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, EP Disclosure 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,221, 4,367,288, 4,409,320, and 4,576,910, and British Patent 2,102,173.

Couplers releasing a photographically useful residue upon coupling are preferably used in the present invention. As DIR couplers, i.e., couplers releasing a development inhibitor, those described in the patents cited in the above-described Research Disclosure No. 17643, VII-F, JP-A-57-151944, JP-A-57-154234, JP-A-60-184248, JP-A-63-37346, JP-A-63-37350, and U.S. Pat. Nos. 4,248,962 and 4,782,012, are preferable.

Preferable examples of a coupler imagewise releasing a nucleating agent or a development accelerator upon development are those described in British Patent 2,097,140, 2,131,188, and JP-A-59-157638 and JP-A-59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11449 and 24241 and JP-A-61-201247; a legand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced in the light-sensitive materials by various known dispersion methods.

Examples of a high-boiling organic solvent used in an oil-in-water dispersion method are described in, e.g., U.S. Pat. No. 2,322,027. Steps, effects, and examples of a latex for impregnation of a latex dispersion method as a polymer dispersion method are described in, e.g., U.S. Pat. No. 4,199,363 and West German Patent (OLS) 2,541,274 and 2,541,230, and a dispersion method using an organic solvent-soluble polymer is described in PCT WO 00723/88.

Examples of an organic solvent for use in the oil-in-water dispersion method are an alkylester of phthalic acid (e.g., dibutylphthalate and dioctylphthalate), phosphate ester (e.g., diphenylphosphate, triphenylphosphate, tricrsylphosphate, and dioctylbutylphosphate), a citrate ester (e.g., tributyl acetylcitrate), a benzoate ester (e.g., octyl benzoate), an alkylamide (e.g., diethyllaurylamide), an aliphatic ester (e.g., dibutoxyethylsuccinate and diethylazelate), and a trimesate ester (e.g., tributyl trimesate). Also, an organic solvent having a boiling point of 30° C. to 150° C. may be used. Examples of such an organic solvent are a lower alkylacetate, e.g., ethyl acetate and butyl acetate, ethyl propionate, secondary butyl alcohol, methylisobutylketone, β-ethoxyethylacetate, and methylcellosolveacetate. Unnecessary components may be removed from these dispersions by washing with water or pressure reduction.

A standard use amount of a color coupler is 0.001 to 1 mol per mol of a light-sensitive silver halide. Preferable amounts of yellow, magenta, and cyan couplers are 0.01 to 0.5 mol, 0.003 to 0.3 mol, and 0.002 to 0.3 mol, respectively, per mol of a silver halide.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, phenol, 4-chloro-3,5-dimethylphenol, 2-phenoxyethanol, and 2-(4-thiazolyl-)benzimidazole described in JP-A-63-257747, JP-A-62-272248, and JP-A-1-80941.

The photographic light-sensitive material used in the present invention is coated on a flexible support such as a plastic film (consisting of cellulose nitrate, cellulose acetate, or polyethyleneterephthalate) or paper which is normally used or a rigid support such as glass. Examples of the support and a coating method are described in detail in Research Disclosure, Vol. 176, Item 17643 XV (p. 27)—XVII (p. 28) (December, 1978).

The light-sensitive material manufactured by the present invention may contain a hydroquinone derivative, an aminophenol derivative, a phenol derivative, a gallate derivative, or an ascorbic acid derivative as a color fog inhibitor.

Various types of decoloration inhibitors can be used in the light-sensitive material of the present invention. Typical examples of an organic decoloration inhibitor for a cyan, magenta, and/or yellow image are hydroquinones, 6-hydroxychromans, 5-hydroxycoumarans, spirochromans, p-alkoxyphenols, hinderedphenols such as a bisphenol, gallate derivatives, methylenedioxy-benzenes, aminophenols, hinderedamines, and ether or ester derivatives obtained by silylating or alkylating a phenolic hydroxyl group of these compounds. In addition, a metal complex such as a (bissalitylaldoximato)nickel complex and a (bis-N,N-dialkyldithiocarbamato)nickel complex can be used.

Practical examples of the organic decoloration inhibitor are described in the following patent specifications.

That is, examples of hydroquinones are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028; examples of 6-hydroxychromans, 5-hydroxycoumarans, and spirochromans are described in U.S. Pat. Nos. 3,432,300, 3,573,050, 3,574,627, 3,698,909, and 3,764,337, and JP-A-52-152225; an example of a spiroindane is described in U.S. Pat. No. 4,360,589; examples of p-alkoxyphenols is described in U.S. Pat. No. 2,735,765, British Patent 2,066,975, JP-A-59-10539, and JP-B-57-19765; examples of hinderedphenols are described in U.S. Pat. No. 3,700,455, JP-A-52-72224, U.S. Pat. No. 4,228,235, and JP-B-52-6623; examples of gallate derivatives, methyleneoxybenzenes, and aminophenols are described in U.S. Pat. Nos. 3,457,079 and 4,332,886 and JP-B-56-21144, respectively; examples of a hinderedamine are described in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; examples of a metal complex are described in U.S. Pat. Nos. 4,050,938 and 4,241,155 and British Patent 2,027,731 (A). 5 to 100 wt % of these compounds are emulsified together with corresponding color couplers and added to light-sensitive layers, thereby achieving the objects. In order to prevent degradation in a cyan dye image caused by heat and especially light, an ultraviolet absorbent can be effectively added to a cyan color-forming layer and two adjacent layers at both side.

Examples of the ultraviolet absorvent are a benzotriazole compound substituted by an aryl group (described in, e.g., U.S. Pat. No. 3,533,794), a 4-thiazolidone compound (described in, e.g., U.S. Pat. Nos. 3,314,794 and 3,352,681), a benzophenone compound (described in, e.g., JP-A-46-2784), a cinnamate compound (described in, e.g., U.S. Pat. Nos. 3,705,805 and 3,707,395), a butadiene compound (described in U.S. Pat. No. 4,045,229), and a benzooxydol compound (described in, e.g., U.S. Pat. No. 3,700,455). In addition, an ultraviolet absorptive coupler (e.g., α-tnaphthol-based cyan dye-forming coupler) and an ultraviolet absorptive polymer can be used. These ultraviolet absorbents may be mordanted in a specific layer.

Of the above compounds, a benzotriazole compound substituted by an aryl group is most preferable.

Gelatin can be advantageously used as a binder or a protective colloid which can be used in emulsion layers of the light-sensitive material of the present invention. Also, another hydrophilic colloid can be used singly or in combination with gelatin.

In the present invention, gelatin may be either lime- or acid-processed. A method of manufacturing gelatin is described in detail in Arthur Weis, "The Macromolecular Chemistry Of Gelatin", (Academic Press, 1964).

The color light-sensitive material of the present invention has at least one layer containing a light-sensitive silver halide emulsion and a coupler on a support. The light-sensitive silver halide emulsion is generally spectrally sensitized to obtain blue, green, or red sensitivities. However, infrared light sensitivity or medium spectral sensitivity may be imparted in accordance with an application. The type of color sensitivity depends on the type of exposure light source such as sun light, tungsten light, an LED, and a laser. The number and order of emulsion layers and non-light-sensitive layers are not particularly limited. For example, the color light-sensitive material has at least one light-sensitive layer constituted by a plurality of silver halide emulsion layers having essentially the same color sensitivity but different sensitivities on a support.

A color photographic light-sensitive material generally uses a combination of the above color-sensitive layers. A relationship between the light sensitivity of an emulsion and the color of a color forming dye of a coupler is generally such that yellow, magenta, and cyan couplers are used for blue-, green-, and red-sensitive layers, respectively. However, this combination can be changed in accordance with an application.

A color developer used in developing of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyehtylaniline, and sulfates, hydrochlorides and p-toluenesulfonates thereof. These compounds can be used in a combination of two or more thereof in accordance with applications.

In general, the color developer contains a pH buffering agent such as a carbonate, a borate or a phosphate of an alkali metal, and a development restrainer or antifoggant such as a bromide, an iodide, benzimidazoles, benzothiazoles or a mercapto compound. If necessary, the color developer may also contain a preservative such as hydroxylamine, diethylhydroxylamine, hydrazine sulfites, phenylsemicarbazides, triethanolamine, catechol sulfonic acids or triethylenediamine(1,4-diazabicyclo[2,2,2]octanes); an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid), and salts thereof.

In order to perform reversal development, black-and-white development is generally performed and then color development is performed. As a black-and-white developer, known black-and-white developing agents, e.g., a dihydroxybenzenes such as hydroquinone, a 3-pyrazolidones such as 1-phenyl-3-pyrazolidone, and an aminophenol such as N-methyl-p-aminophenol can be used singly or in a combination of two or more thereof.

The pH of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In order to decrease the replenishment amount, a contact area of a processing tank with air is preferably decreased to prevent evaporation and oxidation of the solution upon contact with air. The replenishment amount can be decreased by using a means capable of suppressing an accumulation amount of bromide ions in the developer.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with applications. Examples of the bleaching agent are a compound of a multivalent metal such as iron (III), cobalt (III), chromium (VI) and copper (II); a peroxide; a quinone; and a nitro compound. Typical examples of the bleaching agent are a ferricyanide; a dichromate; an organic complex salt of iron (III) or cobalt (III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate; a bromate; a permanganate; and a nitrobenzene. Of these compounds, an iron (III) complex salt of aminopolycarboxylic acid such as an iron (III) complex salt of ethylenediaminetetraacetic acid, and a persulfate are preferred because they can increase a processing speed and prevent an environmental contamination. The iron (III) complex salt of aminopolycarboxylic acid is effective in both the bleaching and bleach-fixing solutions. The pH of the bleaching or bleach-fixing solution using the iron (III) complex salt of aminopolycarboxylic acid is normally 5.5 to 8. In order to increase the processing speed, however, processing can be performed at a lower pH.

A bleaching accelerator can be used in the bleaching solution, the bleach-fixing solution and their pre-bath, if necessary. Effective examples of the bleaching accelerator are: compounds having a mercapto group or a disulfide bond described in, e.g., U.S. Pat. No. 3,893,858, West German Patent 1,290,812, JP-A-53-95630, and Research Disclosure No. 17,129 (July, 1978); a thiazolidine derivative described in JP-A-50-140129; a thiourea derivative described in U.S. Pat. No. 3,706,561; an iodide salt described in JP-A-58-16235; a polyoxyethylene compound described in West German Patent 2,748,430; a polyamine compound described in JP-B-45-8836; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are effective especially in bleach-fixing of a photographic color light-sensitive material.

Examples of the fixing agent are a thiosulfate, a thiocyanate, a thioether-based compound, a thiourea and a large amount of an iodide. Of these compounds, a thiosulfate, especially, ammonium thiosulfate can be used in a widest range of applications. As a preservative of the bleach-fixing solution, a sulfite, a bisulfite or a carbonyl bisulfite adduct is preferred.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248–253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bokabi Gakkai ed., "Dictionary of Antibacterial and Antifungal Agents".

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing formalin and a surface-active agent to be used as a final bath of the photographic color light-sensitive material. Various chelating agents or antifungal agents can be added in the stabilizing bath.

An overflow solution produced upon washing and/or replenishment of the stabilizing solution can be reused in another step such as a desilvering step.

The silver halide color light-sensitive material of the present invention may contain a color developing agent in order to simplify processing and perform a rapid processing. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a high temperature to shorten a processing time, or image quality or stability of a processing solution may be improved at a lower temperature. In order to save silver for the light-sensitive material, processing using cobalt intensification or hydrogen peroxide intensification described in West German Patent No. 2,226,770 or U.S. Pat. No. 3,674,499 may be performed.

When the light-sensitive material of the present invention is to be used in the form of roll, it is preferably housed in a cartridge. A most general example of a cartridge is a 135-format patrone which is currently used. In addition, cartridges proposed in the following patents can be used. JU-A-58-67329, JP-A-58-181035, JP-A-58-182634, Published Unexamined Japanese Utility Model Application No. 58-195236, U.S. Pat. No. 4,221,479, Japanese Patent Application Nos. 63-57785, 63-183344, 63-325638, 1-21862, 1-25362, 1-30246, 1-20222, 1-21863, 1-37181, 1-33108, 1-85198, 1-172595, 1-172594, and 1-172593, U.S. Pat. Nos. 4,846,418, 4,848,693, and 4,832,275.)

The present invention will be described in more detail below by way of its examples.

EXAMPLE 1

(1) Preparation of Emulsions

A. Preparation of Substrate Emulsions

Preparation of Emulsion A-1:

A 0.7% aqueous solution of low-molecular gelatin containing 0.91 mol of potassium bromide was stirred at 30° C., and a potassium bromide 1.01 mol aqueous solution and a silver nitrate 0.94 mol aqueous solution were added to the solution at the same and at a constant flow rate over one minute by a double Jet method (12.7% of the total silver nitrate amount were consumed). 400 ml of a 16% deionized gelatin solution were added to the above solution, and the resultant solution was heated up to 75° C. A silver nitrate 0.88 mol aqueous solution was added to the resultant solution to adjust a pBr to be 2.31 (3.7% of the total silver nitrate amount were consumed). Thereafter, a 14.7N ammonia aqueous solution was added to adjust a pH to be 8.3, and the resultant solution was physically ripened. Thereafter, a potassium bromide 1.33 mol aqueous solution was added to adjust the pH to be 5.5. A potassium bromide 1.33 mol aqueous solution and a silver nitrate 0.88 mol aqueous solution were simultaneously added to be resultant solution over 30 minutes while the pBr was kept at 3.02 (83.6% of the total silver nitrate amount were consumed). The resultant solution was desalted by a conventional flocculation method to prepare a tabular silver bromide emulsion A-1 having an average aspect ratio of 6.5 and a circle-equivalent diameter of 1.0 μm. The use amount of silver nitrate was 156 g.

Preparation of Emulsion A-2:

(Ag ratio of central region, central annular region, and peripheral annular region=16.7/67.3/16; silver iodide content of three regions=0/7.5/0)

1.0 l of a deionized gelatin 0.7% aqueous solution containing 0.57 mol of potassium bromide (solution A) was stirred at 30° C., and a potassium bromide 1.95 mol aqueous solution (solution B) and a silver nitrate 1.9 mol aqueous solution (solution C) were added to the solution at the same and at constant flow rate over 30 seconds by a double jet method (2.06% of the total silver nitrate amount were consumed). After 400 ml of an 8% deionized gelatin solution were added to the above solution, the resultant solution was heated up to 75° C. A silver nitrate 1.12 mol aqueous solution (solution D) was added to adjust a pBr to be 2.13 (1.84% of the total silver amount were consumed). Thereafter, a 14.7N ammonia aqueous solution was added to adjust a pH to be 8.3, and the resultant solution was physically ripened. Thereafter, 1N silver nitrate was added to adjust the pH to be 5.5. A potassium bromide 1.34 mol aqueous solution (solution E) and the solution D were simultaneously added to the resultant solution at an accelerated flow rate (a final flow rate was 2.5 times that at the start) over 11 minutes while the pBr was kept at 1.56 (12.8% of the total silver nitrate were consumed). Thereafter, 1N NaOH was added to adjust the pH to be 9.3. An aqueous solution (solution F) containing 1.34 mol of potassium bromide and 0.108 mol of potassium iodide and the solution D were simultaneously added to the resultant solution at an accelerated flow rate (a final flow rate was 5.5 times that at the start) over 28.5 minutes while the pBr was kept at 1.56 (67.3% of the total silver nitrate amount were consumed). The solution D and a potassium bromide 1.34 mol aqueous solution (solution G) were simultaneously added to the resultant solution at an accelerated flow rate (a final flow rate was twice that at the start) over 10 minutes while the pBr was kept at 2.42 (16% of the total silver nitrate amount were consumed). The resultant solution was desalted by a conventional flocculation method to prepare a tabular silver iodobromide (AgI=5.1 mol %) emulsion A-2 having an average aspect ratio of 6.5 and a circle-equivalent diameter of 1.0 μm. The use amount of silver nitrate was 156 g. The prepared high-aspect ratio tabular silver iodobromide grain had a surface silver iodide concentration of 2.6 mol % and an average silver iodide concentration of 5.1 mol %. That is, the central annular region of the grain had a higher silver iodide concentration than that of its peripheral annular region.

Preparation of Emulsion A-3:

(Ag ratio of central region, central annular region, and peripheral annular region=16.7/67.3/16; silver iodide content of three regions=0/4.6/12)

An emulsion A-3 (AgI=5.0 mol % formulation value) was prepared following the same procedures as for the emulsion A-2 except that the composition of the solution F was changed to an aqueous solution containing 1.35 mol of potassium bromide and 0.065 mol of potassium iodide and the composition of the solution G was changed to an aqueous solution containing 1.24 mol of potassium bromide and 0.17 mol of potassium iodide. The obtained high-aspect ratio tabular silver iodobromide grain had a surface silver iodide concentration of 10.8 mol % and an average silver iodide concentration of 4.9 mol % (actual measurement). That is, the peripheral annular region of the grain had a higher silver iodide concentration than that of its central annular region.

B. Preparation of grains having (or not having) dislocations about the corner

① 500 g of each of the substrate emulsions A-1, A-2, and A-3 (0.5 mol Ag) and 350 cc of distilled water were mixed and heated up to 40° C., and stirred well. The following procedures were performed while this state was maintained.

② A potassium iodide solution (concentration=0.04 mol/l) in an amount corresponding to 1.2 mol % with respect to the silver amount of each substrate emulsion was added over 15 minutes.

③ A silver nitrate solution (concentration=1.02 mol/l) and a sodium chloridessolution (concentration=1.58 mol/l) each in an amount corresponding to 4.1 mol % with respect to the silver amount of each substrate emulsion were added over one minute by a double jet method.

④ A potassium iodide solution (concentration=0.04 mol/l) in an amount corresponding to 1.3 mol % with respect to the silver amount of substrate basic emulsion was added over eight minutes.

⑤ A silver nitrate solution (concentration=1.02 mol/l) and a potassium bromide solution (concentration=1.02 mol/l) each in an amount corresponding to 50 mol % with respect to the silver amount of each substrate emulsion were added over 49 minutes while pBr was maintained at 1.73.

⑥ The resultants were desalted by a flocculation method.

An emulsion (emulsion B-1) prepared by using the emulsion A-1 as a substrate emulsion, an emulsion (emulsion B-2) prepared by using the emulsion A-2 as a substrate emulsion, and an emulsion (emulsion B-3) using the emulsion A-3 as a substrate emulsion, had an average aspect ratio of 6.5 and a circle-equivalent diameter of 1.3 μm.

C. Preparation of grains having non-localized dislocations

Of the procedures ① to ⑥ described in the item B, only the procedures ①, ②, ④, ⑤, and ⑥ were performed. Emulsions C-1, C-2, and C-3 were prepared from the substrate emulsions A-1, A-2, and A-3, respectively.

D. Preparation of grains having no dislocations

Of the procedures ① to ⑥ described in the item B, only the procedures ①, ⑤, and ⑥ were performed. Emulsions D-1, D-2, and D-3 were prepared from the substrate emulsions A-1, A-2, and A-3, respectively.

(2) Observation of dislocations in grain

Direct observation of dislocations was performed for the emulsions B-1, C-1, and D-1 by using a transmission electron microscope. JEM-2,000FXII available from Nihon Denshi K.K. was used as an electron microscope to observe dislocations at an acceleration voltage of 200 kV and a temperature of −120° C.

FIG. 1 shows a photograph of a typical grain obtained by observing the emulsion B-1. As is apparent from FIG. 1, dislocations are concentrated only about the corners of the grain.

Figure 2:
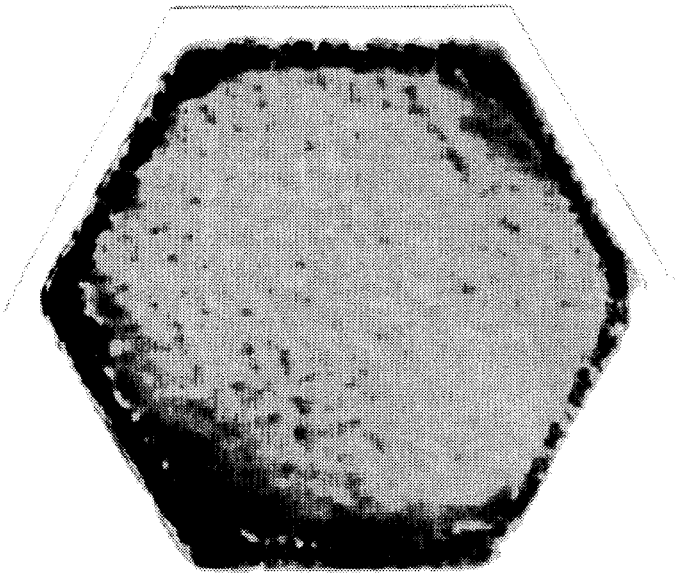
FIG. 2 is an electron micrograph (magnification=63,000) showing a crystal structure of a silver halide grain of an emulsion C-1 as a comparative example of Example 1, in which dislocations are concentrated about an edge of the grain.

FIG. 2 shows a photograph of a typical grain obtained by observing the emulsion C-1. As is apparent from FIG. 2, dislocations are not concentrated but uniformly formed on the edges of the grain.

Figure 3:
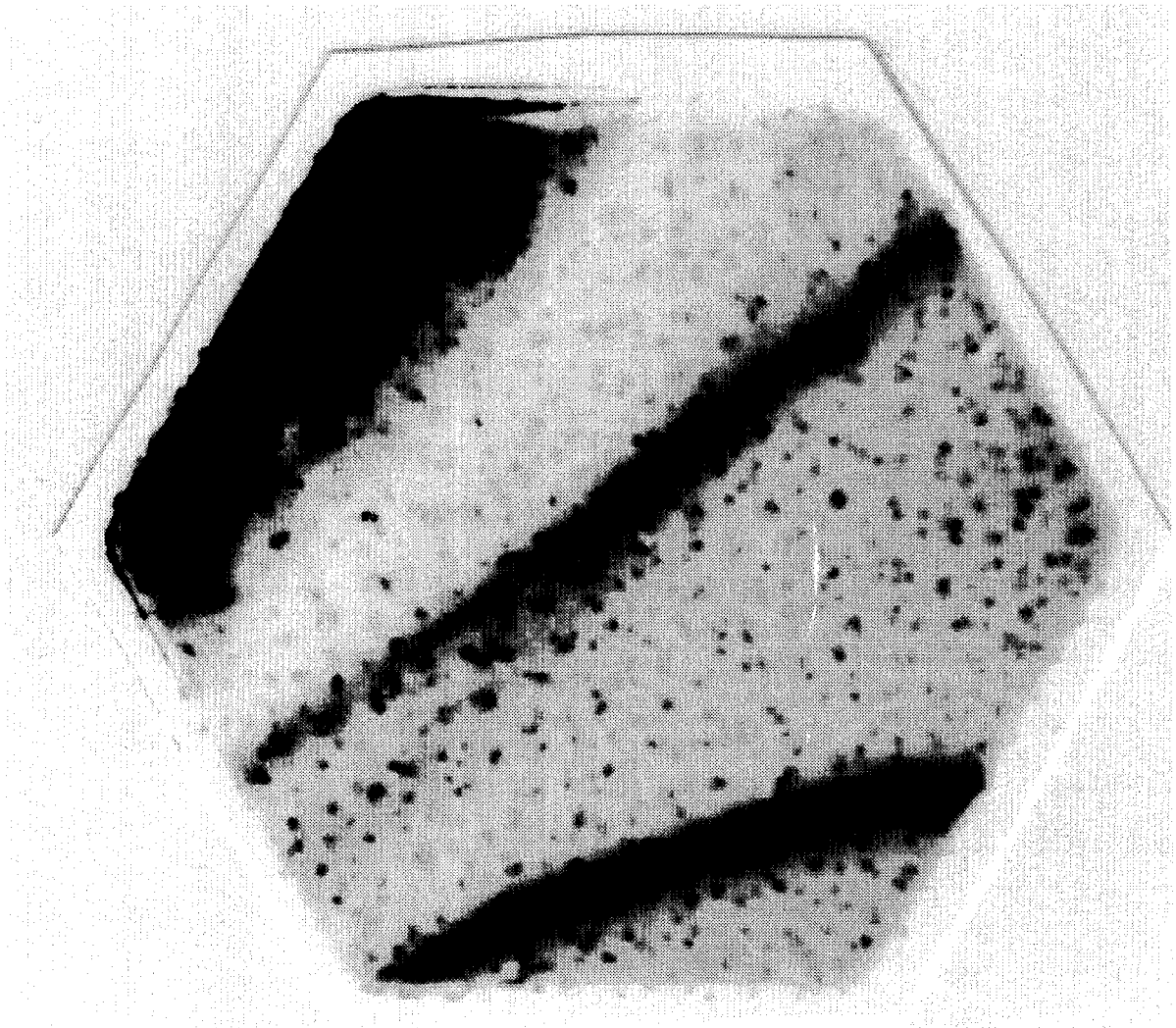
FIG. 3 is an electron micrograph (magnification=78,000) showing a crystal structure of a silver halide grain of an emulsion D-1 as a comparative example of Example 1, in which no dislocations are formed.

FIG. 3 shows a photograph of a typical grain of the emulsion D-1. As is apparent from FIG. 3, no dislocation is formed in the grain.

(3) Chemical Sensitization

1. Sulfur Sensitization:

$1.6\times10^{-7}$ mol of sodium thiosulfate were added to 60 g ($3.6\times10^{-2}$ mol Ag) of each of the emulsions B-1, B-2, B-3, C-1, C-2, C-3, D-1, D-2, and D-3, and the resultant material was kept at 60° C. for 60 minutes to perform sulfur sensitization.

2. Gold-Sulfur Sensitization:

Optimal amounts of sodium thiosulfate, potassium thiocyanate, and chloroauric acid were added to 60 g ($3.6\times10^{-2}$ mol) of each of the emulsions B-1, B-2, B-3, C-1, C-2, C-3, D-1, D-2, and D-3, and the resultant material was kept at 60° C. for 60 minutes to perform gold-sulfur sensitization. In this case, an "optimal amount" is an amount capable of obtaining maximum sensitivity upon 1/100" exposure.

(4) Preparation and Evaluation of Coated Samples

Emulsions subjected to chemical sensitization as described above and protective layers in amounts as listed in Table 1 were coated on triacetylcellulose film supports having undercoating layers, thereby forming samples using the emulsions,

TABLE 1

Emulsion Coating Conditions

| | |
|---|---|
| (1) Emulsion Layer | |
| Emulsion . . . Various emulsions | (silver $3.6\times10^{-2}$ mol/m$^2$) |
| Coupler | ($1.5\times10^{-3}$ mol/m$^2$) |

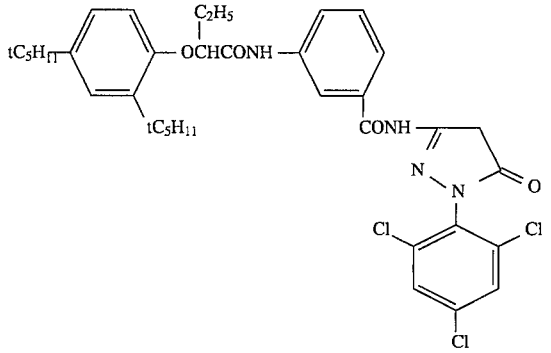

| | |
|---|---|
| Tricresylphosphate | (1.10 g/m$^2$) |
| Gelatin | (2.30 g/m$^2$) |
| (2) Protective Layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours and exposed for 1/100 and 10 seconds through a continuous wedge in the same exposure amount, and the following color development was performed.

The densities of the developed samples were measured by using a green filter.

| Step | Time | Temperature |
|---|---|---|
| Color Development | 2 min. 00 sec. | 40° C. |
| Bleach-Fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Dry | 50 sec. | 65° C. |

The processing solution compositions will be described below.

| | (g) |
|---|---|
| (Color Developing Solution) | |
| Diethylenetriaminepentaacetic Acid | 2.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 l |
| pH | 10.05 |
| (Bleach-Fixing Solution) | |
| Ferric Ammonium Ethylenediaminetetraacetate (Dihydrate) | 90.0 |
| Disodium Ethylenediaminetetraacetate | 5.0 |
| Sodium Sulfite | 12.0 |
| Ammonium Thiosulfate Aqueous Solution (70%) | 260.0 ml |
| Acetic Acid (98%) | 5.0 ml |
| Bleaching Accelerator | 0.01 mol |

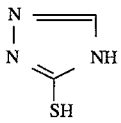

| | |
|---|---|
| Water to make | 1.0 l |
| pH | 6.0 |
| (Washing Solution) | |
| Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 1.5 g/l of sodium sulfate were added. The pH of the solution fell within the range of 6.5 to 7.5. | |
| (Stabilizing Solution) | |
| Formalin (37%) | 2.0 ml |
| Polyoxyethylene-p-monononyl-phenylether (average polymerization degree = 10) | 0.3 |
| Disodium Ethylenediaminetetraacetate | 0.05 |
| Water to make | 1.0 l |
| pH | 5.0 to 8.0 |

The sensitivity is represented by a relative value of a reciprocal of an exposure amount (lux sec.) for giving a density of fog+0.2. The results obtained for the sulfur-sensitized samples are summarized in Table 2, and the results obtained for the gold-sulfur-sensitized samples are summarized in Table 3.

TABLE 2

Relative Sensitivity of Sulfur-Sensitized Sample

| Sample No. (Emulsion Name) | Exposure Time 1/100" | Exposure Time 10" | Remarks |
|---|---|---|---|
| B-1 | 133 | 119 | Present Invention |
| B-2 | 131 | 116 | Present Invention |
| B-3 | 124 | 108 | Present Invention |
| C-1 | 90 | 86 | Comparative Example |
| C-2 | 99 | 69 | Comparative Example |
| C-3 | 103 | 78 | Comparative Example |
| D-1 | 100 | 85 | Comparative Example |
| D-2 | 114 | 96 | Comparative Example |
| D-3 | 103 | 109 | Comparative Example |

Note: all values in table represent relative sensitivities assuming that the sensitivity of sample D-1 upon 1/100-sec exposure is 100.

TABLE 3

Relative Sensitivity of Gold-Sulfur-Sensitized Sample

| Sample No. (Emulsion Name) | Exposure Time 1/100" | Exposure Time 10" | Remarks |
|---|---|---|---|
| B-1 | 145 | 143 | Present Invention |
| B-2 | 141 | 132 | Present Invention |
| B-3 | 144 | 156 | Present Invention |
| C-1 | 134 | 125 | Comparative Example |
| C-2 | 129 | 121 | Comparative Example |
| C-3 | 114 | 108 | Comparative Example |
| D-1 | 100 | 85 | Comparative Example |
| D-2 | 115 | 99 | Comparative Example |
| D-3 | 103 | 114 | Comparative Example |

Note: all values in table represent relative sensitivities assuming that the sensitivity of sample D-1 upon 1/100-sec exposure is 100.

As is apparent from Tables 2 and 3, both the 1/100-sec sensitivity and the 10-sec sensitivity of the emulsions prepared by the method B of the present invention were higher than those of the emulsions prepared by the methods C and D, i.e., the effect of the present invention was significant.

EXAMPLE 2

A plurality of layers having the following compositions were formed on undercoated triacetylcellulose film supports to prepare samples 201 to 209, in which, the (optimally gold-sulfur-sensitized) emulsions B-1, B-2, B-3, C-1, C-2, C-3, D-1, D-2, and D-3 described in Example-1, were contained in the first blue-sensitive emulsion layers of the multilayered color light-sensitive materials.

(Compositions of Light-Sensitive Layers)

Numerals corresponding to the the respective components indicate coating amounts in units of g/m$^2$. The silver halide is represented in a silver-converted coated amount. A coating amount of the sensitizing dye is represented in units of mols per mol of the silver halide in the same layer.

| | |
|---|---|
| **Layer 1: Antihalation Layer** | |
| Black Colloid Silver | silver 0.18 |
| Gelatin | 1.40 |
| **Layer 2: Interlayer** | |
| 2,5-di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| **Layer 3: Donor Layer with Interlayer Effect on Red-Sensitive Layer** | |
| Emulsion J | silver 1.2 |
| Emulsion K | silver 2.0 |
| Sensitizing Dye IV | $4 \times 10^{-4}$ |
| EX-10 | 0.10 |
| HBS-1 | 0.10 |
| HBS-2 | 0.10 |
| **Layer 4: Interlayer** | |
| EX-5 | 0.040 |
| HBS-1 | 0.020 |
| Gelatin | 0.80 |
| **Layer 5: 1st Red-Sensitive Emulsion Layer** | |
| Emulsion A | silver 0.25 |
| Emulsion B | silver 0.25 |
| Sensitizing Dye I | $1.5 \times 10^{-4}$ |
| Sensitizing Dye II | $1.8 \times 10^{-5}$ |
| Sensitizing Dye III | $2.5 \times 10^{-4}$ |
| EX-2 | 0.335 |
| EX-10 | 0.020 |
| U-1 | 0.07 |
| U-2 | 0.05 |
| U-3 | 0.07 |
| HBS-1 | 0.060 |
| Gelatin | 0.87 |
| **Layer 6: 2nd Red-Sensitive Emulsion Layer** | |
| Emulsion G | silver 1.0 |
| Sensitizing Dye I | $1.4 \times 10^{-4}$ |
| Sensitizing Dye II | $1.4 \times 10^{-5}$ |
| Sensitizing Dye III | $2.0 \times 10^{-4}$ |
| EX-2 | 0.400 |
| EX-3 | 0.050 |
| EX-10 | 0.015 |
| U-1 | 0.07 |
| U-2 | 0.05 |
| U-3 | 0.07 |
| Gelatin | 1.30 |
| **Layer 7: 3rd Red-Sensitive Emulsion Layer** | |
| Emulsion D | silver 1.60 |
| Sensitizing Dye I | $1.0 \times 10^{-4}$ |
| Sensitizing Dye II | $1.4 \times 10^{-5}$ |
| Sensitizing Dye III | $2.0 \times 10^{-4}$ |
| EX-3 | 0.010 |
| EX-4 | 0.080 |
| EX-2 | 0.097 |

| | | |
|---|---|---|
| HBS-1 | | 0.22 |
| HBS-2 | | 0.10 |
| Gelatin | | 1.63 |
| **Layer 8: Interlayer** | | |
| EX-5 | | 0.040 |
| HBS-1 | | 0.020 |
| Gelatin | | 0.80 |
| **Layer 9: 1st Green-Sensitive Emulsion Layer** | | |
| Emulsion A | silver | 0.15 |
| Emulsion B | silver | 0.15 |
| Sensitizing Dye V | | $3.0 \times 10^{-5}$ |
| Sensitizing Dye VI | | $1.0 \times 10^{-4}$ |
| Sensitizing Dye VII | | $3.8 \times 10^{-4}$ |
| Sensitizing Dye IV | | $5.0 \times 10^{-5}$ |
| EX-6 | | 0.260 |
| EX-1 | | 0.021 |
| EX-7 | | 0.030 |
| EX-8 | | 0.005 |
| HBS-1 | | 0.100 |
| HBS-3 | | 0.010 |
| Gelatin | | 0.63 |
| **Layer 10: 2nd Green-Sensitive Emulsion Layer** | | |
| Emulsion C | silver | 0.45 |
| Sensitizing Dye V | | $2.1 \times 10^{-5}$ |
| Sensitizing Dye VI | | $7.0 \times 10^{-5}$ |
| Sensitizing Dye VII | | $2.6 \times 10^{-4}$ |
| Sensitizing Dye IV | | $5.0 \times 10^{-5}$ |
| EX-6 | | 0.094 |
| EX-22 | | 0.018 |
| EX-7 | | 0.026 |
| HBS-1 | | 0.160 |
| HBS-3 | | 0.008 |
| Gelatin | | 0.50 |
| **Layer 11: 3rd Green-Sensitive Emulsion Layer** | | |
| Emulsion E | silver | 1.2 |
| Sensitizing Dye V | | $3.5 \times 10^{-5}$ |
| Sensitizing Dye VI | | $8.0 \times 10^{-5}$ |
| Sensitizing Dye VII | | $3.0 \times 10^{-4}$ |
| Sensitizing Dye IV | | $0.5 \times 10^{-5}$ |
| EX-13 | | 0.015 |
| EX-11 | | 0.100 |
| EX-1 | | 0.025 |
| HBS-1 | | 0.25 |
| HBS-2 | | 0.10 |
| Gelatin | | 1.54 |
| **Layer 12: Yellow Filter Layer** | | |
| Yellow Colloid Silver | silver | 0.05 |
| EX-5 | | 0.08 |
| HBS-1 | | 0.03 |
| Gelatin | | 0.95 |

| | | |
|---|---|---|
| **Layer 13: 1st Blue-Sensitive Emulsion Layer** | | |
| One Of Emulsions B-1, B-2, B-3, C-1, C-2, C-3, D-1, D-2, and D-3 | silver | 0.22 |
| Sensitizing Dye VIII | | $7.0 \times 10^{-4}$ |
| EX-9 | | 0.721 |
| EX-8 | | 0.042 |
| HBS-1 | | 0.28 |
| Gelatin | | 1.10 |
| **Layer 14: 2nd Blue-Sensitive Emulsion Layer** | | |
| Emulsion G | silver | 0.45 |
| Sensitizing Dye VIII | | $2.1 \times 10^{-4}$ |
| EX-9 | | 0.154 |
| EX-10 | | 0.007 |
| HBS-1 | | 0.05 |
| Gelatin | | 0.78 |
| **Layer 15: 3rd Blue-Sensitive Emulsion Layer** | | |
| Emulsion H | silver | 0.77 |
| Sensitizing Dye VIII | | $2.2 \times 10^{-4}$ |
| EX-9 | | 0.20 |
| HBS-1 | | 0.07 |
| Gelatin | | 0.69 |
| **Layer 16: 1st Protective Layer** | | |
| Emulsion I | silver | 0.20 |
| U-4 | | 0.11 |
| U-5 | | 0.17 |
| HBS-1 | | 0.05 |
| Gelatin | | 1.00 |
| **Layer 17: 2nd Protective Layer** | | |
| Polymethylacrylate Grains (diameter = about 1.5 μm) | | 0.54 |
| S-1 | | 0.20 |
| Gelatin | | 1.20 |

In addition to the above components, a gelatin hardener H-1, EX-14 to 21, and a surfactant were added to each layer. The contents of the emulsions A, B, C, D, E, F, G, H, I, J, and K used in formation of the above samples are listed in Table 4. Formulas or names of the compounds used are listed in Table A to be presented later.

TABLE 4

| | Average AgI Content (%) | Average Grain Size (μM) | Variation Coefficient of Grain Size (%) | Diameter/Thickness Ratio | Silver Amount Ratio (AgI content %) |
|---|---|---|---|---|---|
| Emulsion A | 4.0 | 0.45 | 27 | 1 | Core/Shell = 1/3(13/1), Double Structure Grain |
| Emulsion B | 8.9 | 0.70 | 14 | 1 | Core/Shell = 3/7(25/2), Double Structure Grain |
| Emulsion C | 10 | 0.75 | 30 | 2 | Core/Shell = 1/2(24/3), Double Structure Grain |
| Emulsion D | 16 | 1.05 | 35 | 2 | Core/Shell = 4/6(40/0), Double Structure Grain |
| Emulsion E | 10 | 1.05 | 35 | 3 | Core/Shell = 1/2(24/3), Double Structure Grain |
| Emulsion G | 14.0 | 0.75 | 25 | 2 | Core/Shell = 1/2(42/0), Double Structure Grain |
| Emulsion H | 14.5 | 1.30 | 25 | 3 | Core/Shell = 37/63(34/3), Double Structure Grain |
| Emulsion I | 1 | 0.07 | 15 | 1 | Homogeneous Grain |
| Emulsion J | 5 | 0.90 | 30 | 2 | Core/Shell = 1/1(10/0), Double Structure Grain |
| Emulsion K | 7 | 1.50 | 25 | 2 | Core/Shell = 1/1(14/0), Double Structure Grain |

The samples 201 to 209 obtained as described above were exposed and processed in accordance with a processing method described in Table 5 by using an automatic developing machine (until an accumulated replenishing amount of a bleaching solution was increased to three times a mother solution tank capacity).

TABLE 5

| Processing Method | | | | |
|---|---|---|---|---|
| Process | Time | Temperature | Replenishing* Amount | Tank Volume |
| Color Development | 3 min. 15 sec. | 38° C. | 33 ml | 20 l |
| Bleaching | 6 min. 30 sec. | 38° C. | 25 ml | 40 l |
| Washing | 2 min. 10 sec. | 24° C. | 1,200 ml | 20 l |
| Fixing | 4 min. 20 sec. | 38° C. | 25 ml | 30 l |
| Washing (1) | 1 min. 05 sec. | 24° C. | Counter flow piping from (2) to (1) | 10 l |
| Washing (2) | 1 min. 00 sec. | 24° C. | 1,200 ml | 10 l |
| Stabilization | 1 min. 05 sec. | 38° C. | 25 ml | 10 l |
| Drying | 4 min. 20 sec. | 55° C. | | |

*A replenishing amount per meter of a 35-mm wide sample.

The compositions of the process solutions will be presented below.

| | Mother Solution (g) | Replenishment Solution (g) |
|---|---|---|
| Color Developing Solution: | | |
| Diethylenetriamine-pentaacetate | 1.0 | 1.1 |
| 1-hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-(N-ethyl-N-β-hydroxylethylamino)-2-methylalinine Sulfate | 4.5 | 5.5 |
| Water to make | 1.0 l | 1.0 l |
| pH | 10.05 | 10.10 |

-continued

| | Mother Solution (g) | Replenishment Solution (g) |
|---|---|---|
| Bleaching Solution: | | |
| Ferric Sodium Ethylenediamine-tetraacetate Trihydrate | 100.0 | 120.0 |
| Disodium Ethylene-diaminetetraacetate | 10.0 | 11.0 |
| Ammonium Bromide | 140.0 | 160.0 |
| Ammonium Nitrate | 30.0 | 35.0 |
| Ammonia Water (27%) | 6.5 ml | 4.0 ml |
| Water to make | 1.0 l | 1.0 l |
| pH | 6.0 | 5.7 |
| Fixing Solution: | | |
| Disodium Ethylene-diaminetetraacetate | 0.5 | 0.7 |
| Sodium Sulfite | 7.0 | 8.0 |
| Sodium Bisulfite | 5.0 | 5.5 |
| Ammonium Thiosulfate Aqueous Solution (70%) | 170.0 ml | 200.0 ml |
| Water to make | 1.0 l | 1.0 l |
| pH | 6.7 | 6.6 |
| Stabilizing Solution: | | |
| Formalin (37%) | 2.0 ml | 3.0 ml |
| Polyoxyethylene-p-monononylphenylether (average polymerization degree = 10) | 0.3 | 0.45 |
| Disodium Ethylene-diaminetetraacetate | 0.05 | 0.08 |
| Water to make | 1.0 l | 1.0 l |
| pH | 5.0–8.0 | 5.0–8.0 |

The sensitivity of the first blue-sensitive layer was evaluated on the basis of an exposure amount for giving a density higher by 1.5 than a minimum yellow density. When the emulsions (B-1, B-2, and B-3) of the present invention in which dislocations were concentrated about the corners were used, sensitivities of both 10-sec exposure and 1/100-sec exposure were higher than those of the emulsions (C-1, C-2, and C-3) in which dislocations were uniformly present on an edge of the grain and the emulsions (D-1, D-2, and D-3) in which dislocations were not present, i.e., the effect of the present invention was significant.

TABLE A

EX-1

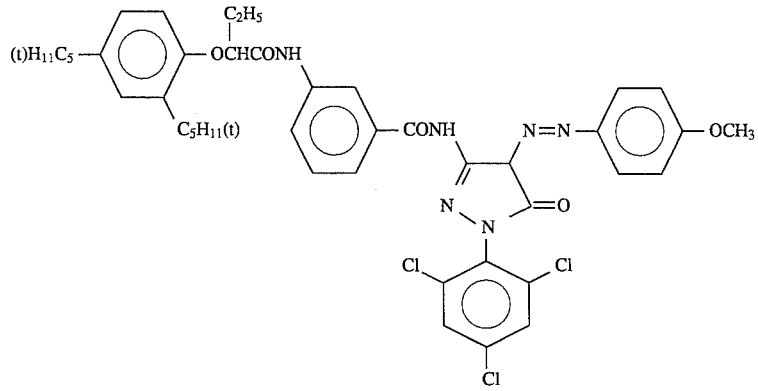

TABLE A-continued
EX-2
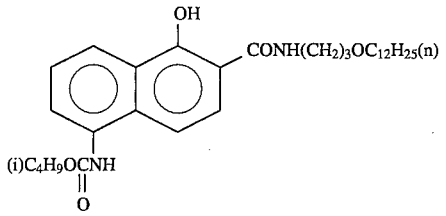
EX-3
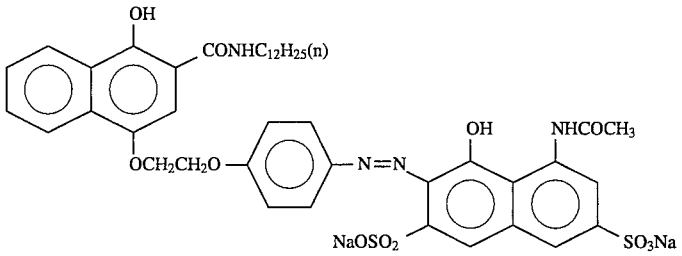
EX-4
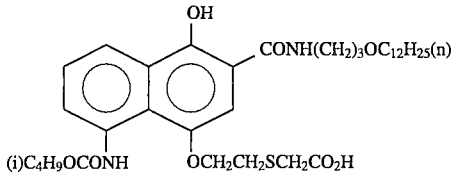
EX-5
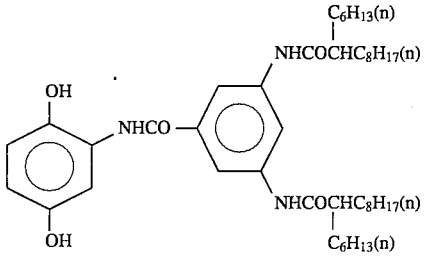
EX-6
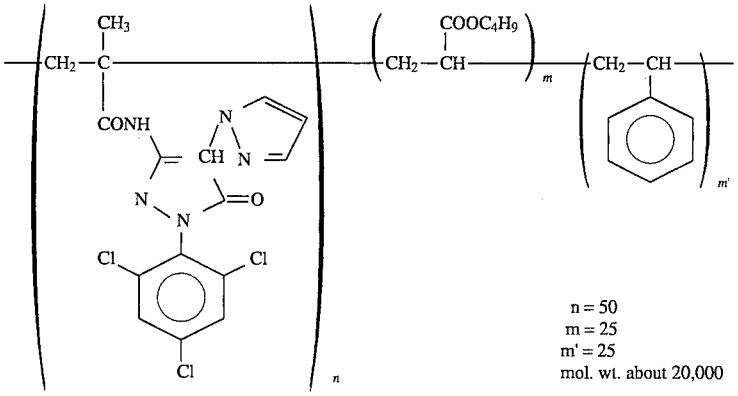

TABLE A-continued
EX-7
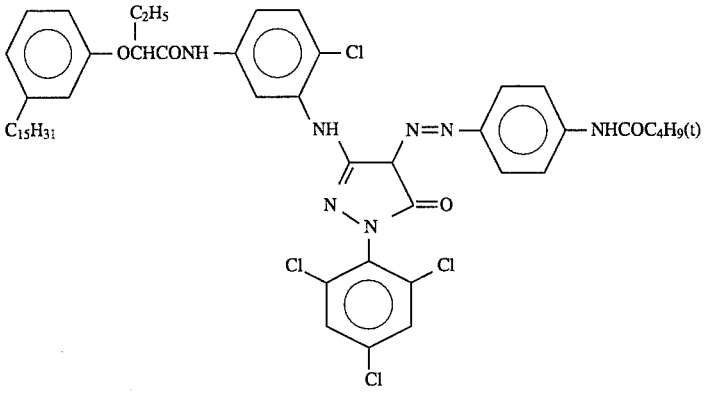
EX-8
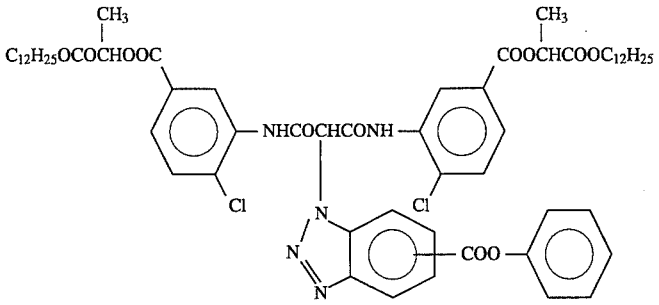
EX-9
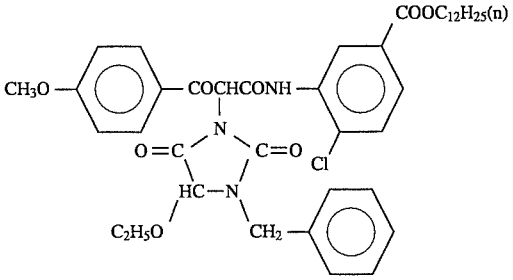
EX-10
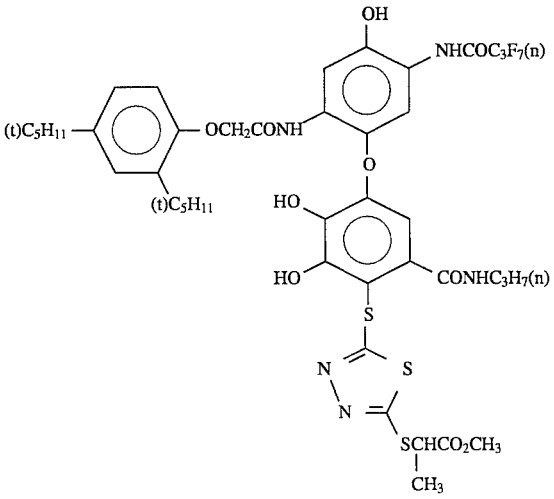

TABLE A-continued
EX-11
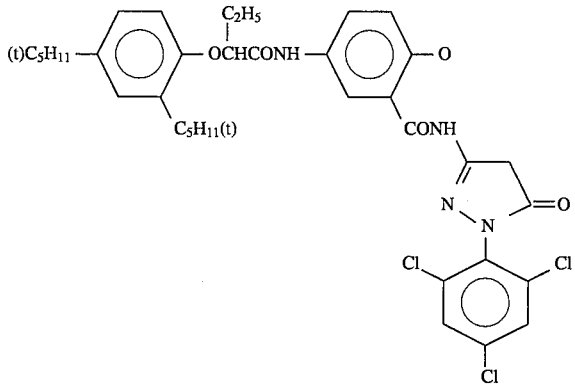
EX-12
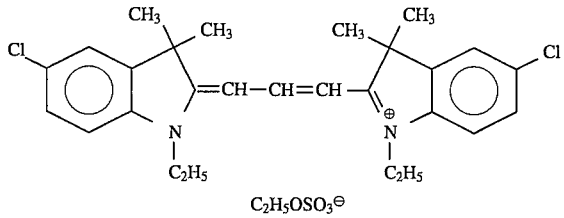
EX-13
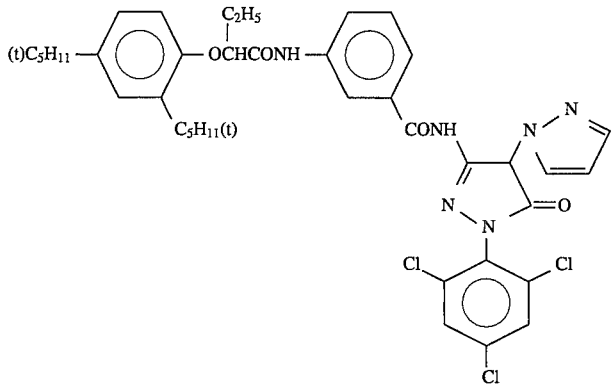
U-1
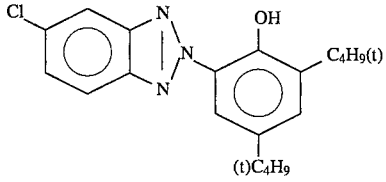
U-2
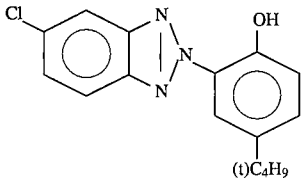
U-3
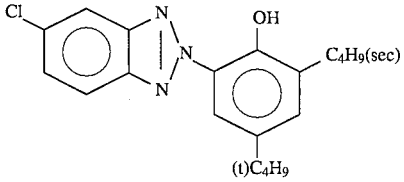

TABLE A-continued
U-4
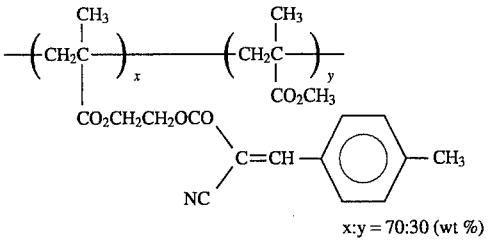
x:y = 70:30 (wt %)
UV-5
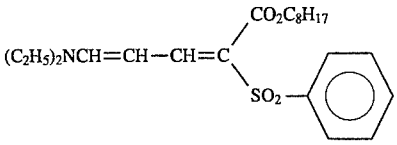
HBS-1 tricresyl phosphate
HBS-2 di-n-butyl phthalate
HBS-3
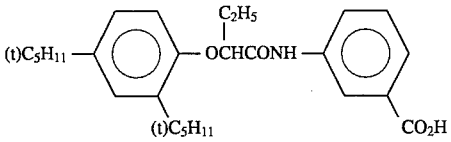
Sensitizing dye I
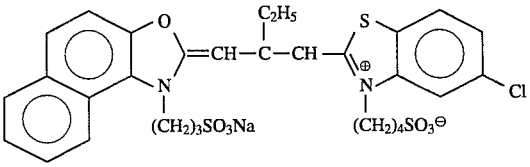
Sensitizing dye II
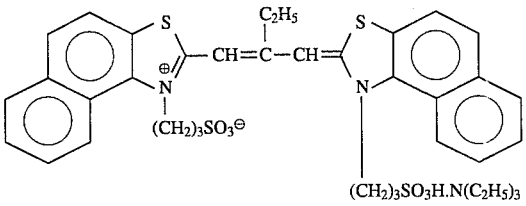
Sensitizing dye III
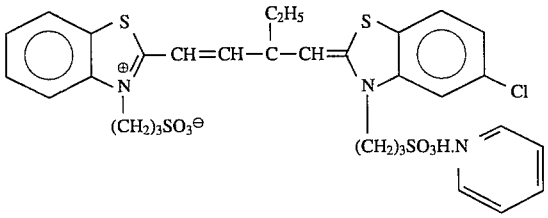
Sensitizing dye IV
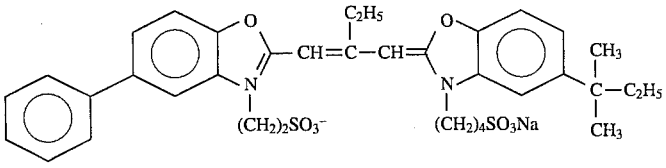
Sensitizing dye V
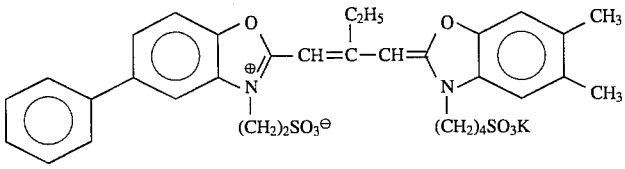

TABLE A-continued
| | |
|---|---|
| Sensitizing dye VI | 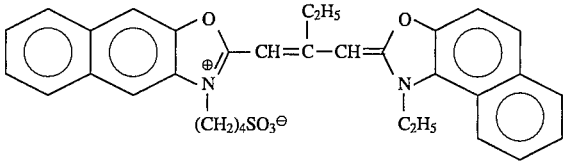 |
| Sensitizing dye VII | 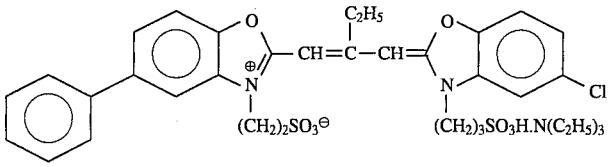 |
| Sensitizing dye VIII | 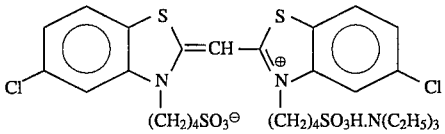 |
| S-1 | 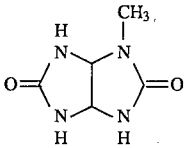 |
| H-1 | $CH_2{=}CH{-}SO_2{-}CH_2{-}CONH{-}CH_2$<br>$CH_2{=}CH{-}SO_2{-}CH_2{-}CONH{-}CH_2$ |
| EX-14 | 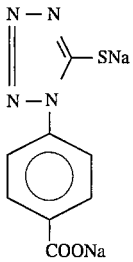 |
| EX-15 | 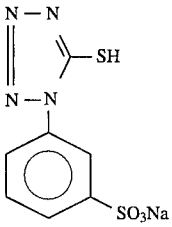 |
| EX-16 | Copolymer of polyvinylpyroridone and polyvinylalcohol |
| EX-17 | 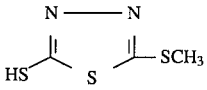 |
| EX-18 | 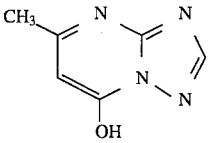 |
| EX-19 | 1,2-benzisothiazoline-3-one |
| EX-20 | n-butyl-p-hydroxybenzoate |
| EX-21 | 2-phenoxyethanol |

TABLE A-continued

EX-22

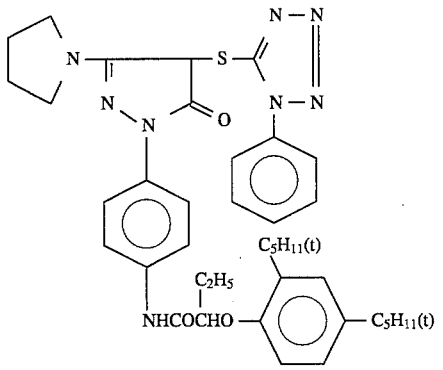

What is claimed is:

1. A silver halide photographic emulsion containing tabular silver halide grains having an aspect ratio of 2 or more and having dislocations concentrated about at least one corner of the grain wherein the tabular silver halide grains are formed by a method comprising: a step of junctioning a guest silver halide grain to at least one corner of a host tabular silver halide grain to form a junctioned silver halide grain, wherein the guest silver halide grain is silver iodide grain or silver halide grain having silver iodide content higher than that of the host tabular grain, and the host silver halide tabular grain is silver iodobromide or silver chloroiodobromide containing 30 mole % or less of silver iodide; and a step of adding simultaneously to the solution containing said junctioned silver halide grain after formation of said junctioned silver halide grain, a silver nitrate solution and potassium bromide solution, or a silver nitrate solution and a solution mixture of potassium bromide and potassium iodide to form said dislocations.

2. The silver halide photographic emulsion according to claim 1, wherein tabular silver halide grains having a grain thickness of less than 0.5 μm, a grain diameter of 0.3 μm or more, and an aspect ratio of 2 or more account for at least 50% of a total projected area of all silver halide grains in the emulsion.

3. The silver halide photographic emulsion according to claim 1, wherein the tabular silver halide grains having a grain thickness of 0.05 μm to less than 0.5 μm, a grain diameter of 0.3 μm to 5.0 μm, and an aspect ratio of 2 or more account for at least 50% of a total projected area of all silver halide grains in the emulsion.

4. The silver halide photographic emulsion according to claim 1, wherein the tabular silver halide grains having a grain thickness of less than 0.5 μm, a grain diameter of 0.3 μm or more, and an aspect ratio of 3 to less than 8 account for at least 50% of a total projected area of all silver halide grains in the emulsion.

5. The silver halide photographic emulsion according to claim 1, wherein the tabular silver halide grains having a grain thickness of 0.05 μm to less than 0.5 μm, a grain diameter of 0.3 μm to 5.0 μm, and an aspect ratio of 3 to less than 8 account for at least 50% of a total projected area of all silver halide grains in the emulsion.

6. The silver halide photographic emulsion according to claim 1, wherein the tabular silver halide grains having a grain thickness of 0.05 μm to less than 0.5 μm, a grain diameter of 0.3 μm to 5.0 μm, and an aspect ratio of 3 to less than 8 account for at least 80% of a total projected area of all silver halide grains in the emulsion.

7. The silver halide photographic emulsion according to claim 1, wherein the aspect ratio is from 2 to less than 8.

8. The silver halide photographic emulsion according to claim 1, wherein the diameter of the tabular silver halide grains is 0.3 to 5.0 μm and the thickness of the final tabular silver halide grains is 0.05 to 0.5 μm.

9. The silver halide photographic emulsion according to claim 1, wherein said guest silver iodide grain and said guest silver halide grain contains 90% or more silver iodide.

10. A method of manufacturing a silver halide emulsion containing tabular silver halide grains having an aspect ratio of two or more, grain thickness of less than 0.5 μm, grain diameter of 0.3 μm or more and having dislocations concentrated about at least one corner of the grains comprising a step of junctioning a guest silver halide grain to at least one corner of a host tabular silver halide grain by halide conversion using iodide ions to form a junctioned silver halide grain, and a step of subsequently growing said junctioned silver halide grain by adding simultaneously a silver nitrate solution and potassium bromide solution, or a silver nitrate solution and a solution mixture of potassium bromide and potassium iodide to the solution containing said junctioned silver halide grain after formation of said junctioned silver halide grain to form said dislocations; wherein the host tabular silver halide grain is silver iodobromide or silver chloroiodobromide containing 30% or less of iodide, and the guest silver halide grain is silver iodide or silver halide grains having silver iodide content higher than that of the host tabular grain; and said tabular silver halide grains having an aspect ratio of 2 or more account for at least 50 % of a total projected area of all silver halide grains in the emulsion.

11. A silver halide photographic emulsion produced by the process of claim 10.

12. A method of manufacturing a silver halide emulsion containing tabular silver halide grains having an aspect ratio of two or more, grain thickness of less than 0.5 μm, grain diameter of 0.3 μm or more and having dislocations concentrated about at least one corner of the grains comprising a step of junctioning a guest silver halide grain directly to at least one corner of a host tabular silver halide grain to form a junctioned silver halide grain, and a step of subsequently growing said junctioned silver halide grain by adding simultaneously to the solution containing said junctioned silver halide grain after formation of said junctioned silver halide grain a silver nitrate solution and potassium bromide solution, or a silver nitrate solution and a solution mixture of potassium bromide and potassium iodide to form said dislocations; wherein the host tabular silver halide grains are silver iodobromide or silver chloroiodobromide containing 30% or less of iodide, and the guest silver halide grain is silver iodide or silver halide grain having silver iodide content higher than that of the host tabular silver halide grains, and said tabular silver halide grains having an aspect ratio of 2 or more account for at least 50% of a total projected area of all silver halide grains in the emulsion.

13. The method of manufacturing a silver halide photographic emulsion according to claim 12, which comprises junctioning the guest silver iodide grain or the guest silver halide grain, having a silver iodide content that is higher than at least that of the host tabular silver halide grains, by epitaxial growth to the corners of said host tabular silver halide grains using said tabular silver halide grains of silver iodobromide as a host and adding aqueous solutions of potassium iodide and silver nitrate in an amount of 0.5 to 10 mol % of the silver of the host, by a double jet method without using any site director.

14. The method of manufacturing a silver halide photographic emulsion according to claim 13, wherein the time of addition of the aqueous solution of potassium iodide and silver nitrate is 5 to 0.2 minutes.

15. The method of manufacturing a silver halide photographic emulsion according to claim 12, which comprises adding a silver halide solvent to a solution containing host grains, and then adding aqueous solutions of potassium iodide and silver nitrate.

16. The method of manufacturing a silver halide photographic emulsion according to claim 15, which comprises adding each of said aqueous solutions in an amount of 0.5 to 10 mol % with respect to the host grains.

17. The method of manufacturing a silver halide photographic emulsion according to claim 12, which comprises growing silver chloride at the corners of said host tabular silver halide grains with a water-soluble iodide as a site director.

18. The method of manufacturing a silver halide photographic emulsion according to claim 12, which comprises adding potassium iodide for halide conversion in an amount of 0.1 to 10 mol % with respect to the silver of a host tabular grain.

19. A photographic light-sensitive material comprising at least two light-sensitive silver halide emulsion layers having different color sensitivities on a support, wherein at least one of said emulsion layers contains the silver halide photographic emulsion according to claim 2 and at least one coupler which couples with the oxidized form of a color developing agent to form a dye.

20. A photographic light-sensitive material comprising at least two light-sensitive silver halide emulsion layers having different color sensitivities on a support, wherein at least one of said emulsion layers contains the silver halide photographic emulsion according to claim 3 and at least one coupler which couples with the oxidized form of a color developing agent to form a color.

21. A photographic light-sensitive material comprising at least two light-sensitive silver halide emulsion layers having different color sensitivities on a support, wherein at least one of said emulsion layers contains the silver halide photographic emulsion according to claim 4 and at least one coupler which couples with the oxidized form of a color developing agent to form a dye.

22. A photographic light-sensitive material comprising at least two light-sensitive silver halide emulsion layers having different color sensitivities on a support, wherein at least one of said emulsion layers contains the silver halide photographic emulsion according to claim 5 and at least one coupler which couples with the oxidized form of a color developing agent to form a dye.

23. A photographic light-sensitive material comprising at least two light-sensitive silver halide emulsion layers having different color sensitivities on a support, wherein at least one of said emulsion layers contains the silver halide photographic emulsion according to claim 6 and at least one coupler which couples with the oxidized form of a color developing agent to form a dye.

24. A silver halide photographic emulsion containing tabular silver halide grains having an aspect ratio of 2 or more and having dislocations concentrated about at least one corner of the grain wherein the tabular silver halide grains are formed by a method comprising: a step of junctioning a guest silver halide grain to at least one corner of a host tabular silver halide grain to form a junctioned silver halide grain, wherein the guest silver halide grain is silver iodide grain or silver halide grain having silver iodide content higher than that of the host tabular grains, and the host silver halide tabular grain is silver iodobromide or silver chloroiodobromide; and a step of adding simultaneously to the solution containing said junctioned silver halide grain after the formation of said junctioned silver halide grain, a silver nitrate solution and potassium bromide solution, or a silver nitrate solution and a solution mixture of potassium bromide and potassium iodide to form said dislocations.

25. A silver halide photographic emulsion produced by the process of claim 12.

* * * * *